US007078581B1

(12) United States Patent
Maddrell et al.

(10) Patent No.: US 7,078,581 B1
(45) Date of Patent: Jul. 18, 2006

(54) ENCAPSULATION OF WASTE

(75) Inventors: Ewan Robert Maddrell, Seascale (GB); Melody Lyn Carter, Figtree (AU)

(73) Assignee: British Nuclear fuels PLC (GB)

( * ) Notice: Subject to any disclaimer, the term of this patent is extended or adjusted under 35 U.S.C. 154(b) by 512 days.

(21) Appl. No.: 10/129,310

(22) PCT Filed: Nov. 8, 2000

(86) PCT No.: PCT/GB00/04284

§ 371 (c)(1),
(2), (4) Date: Aug. 13, 2002

(87) PCT Pub. No.: WO01/35422

PCT Pub. Date: May 17, 2001

(30) Foreign Application Priority Data

Nov. 12, 1999 (GB) ..... 9926674.4

(51) Int. Cl.
*G21F 9/34* (2006.01)
*G21F 9/28* (2006.01)
*G21F 9/20* (2006.01)

(52) U.S. Cl. ..... 588/10; 588/16; 588/19; 252/638; 252/640; 252/635; 252/625

(58) Field of Classification Search ..... 588/10
See application file for complete search history.

(56) References Cited

U.S. PATENT DOCUMENTS 4,274,976 A * 6/1981 Ringwood ..... 588/15
4,329,248 A 5/1982 Ringwood
4,383,855 A * 5/1983 Aaron et al. ..... 419/19
5,596,615 A * 1/1997 Nakamura et al. ..... 376/438
6,137,025 A * 10/2000 Ebbinghaus et al. ..... 588/10
6,740,298 B1 * 5/2004 Raginskii et al. ..... 422/274

FOREIGN PATENT DOCUMENTS

| | | | |
|---|---|---|---|
| EP | 0007236 | B1 | 4/1982 |
| EP | 0044692 | B1 | 10/1986 |
| EP | 0244534 | B1 | 1/1992 |
| EP | 0444104 | B1 | 2/1995 |
| GB | 2163893 | A | 3/1986 |
| WO | WO9801867 | A1 | 1/1998 |
| WO | WO9960577 | A1 | 11/1999 |

* cited by examiner

*Primary Examiner*—Joseph D. Anthony
(74) *Attorney, Agent, or Firm*—Dickinson Wright PLLC; Robert L. Stcarns

(57) ABSTRACT

A ceramic waste immobilizing material for the encapsulation of high level radioactive waste (HLW), e.g. resulting from the reprocessing of irradiated nuclear fuel. The ceramic waste immobilising material enables waste ions from at least fission products in irradiated nuclear fuel to be dissolved in substantially solid solution form. The ceramic waste immobilising medium has a matrix comprising phases of hollandite, perovskite and zirconolite in which the waste ions are dissolved. The invention also includes a method of immobilizing HLW from reprocessed nuclear fuel assemblies comprising the steps of mixing a liquor containing the HLW with a precursor material comprising oxides or oxide precursors of at least titanium, calcium and barium to form a slurry, drying the slurry, and calcining the dried slurry under a reducing atmosphere to form a powder comprising 30–65 weight % waste.

9 Claims, 1 Drawing Sheet

ENCAPSULATION OF WASTE

BACKGROUND OF THE INVENTION

1. Technical Field

The present invention relates to a ceramic material for the encapsulation of high level radioactive waste, e.g. resulting from the reprocessing of irradiated nuclear fuel. The term reprocessing used herein includes not only processing which separates irradiated fuel to provide new fuel products but any processing which includes any separation of irradiated fuel, e.g. any so-called spent fuel reconditioning process.

2. Related Art

Vitrification has been the preferred method of encapsulating highly active wastes comprising fission products resulting from the reprocessing of irradiated fuels. The method involves the incorporation of the waste within a continuous amorphous matrix. However, waste streams which are likely to arise in the future due to developments to the so-called PUREX process (so-called Advanced PUREX process) may not be suitable for containment by the vitrification technique due principally to relatively high levels of iron, chromium and zirconium which result from the non-fuel components of fuel assemblies which are also taken into solution in the envisaged new reprocessing techniques. In particular it is envisaged that an electrochemical dissolution may be used at the Head End of a future. Advanced Purex reprocessing plant. In contrast to current shear/leech procedures, whole fuel assemblies will be dissolved continuously in an electrochemical cell. Approximately 15% of the Zircaloy cladding, together with all of the stainless steel and Inconel components of the fuel assembly are expected to be taken into solution and remain in the HA raffinate, after solvent extraction, in addition to the fission products and non-recycled actinides.

In addition to the need to reduce the costs of reprocessing operations, a further important consideration is that of minimising the quantity of waste produced without compromise to the durability of the waste form. In the context of developments to the PUREX process referred to above, this waste minimisation objective can be applied to comparisons with the total amount of waste produced by current PUREX reprocessing technology and also direct disposal. In conventional oxide fuel PUREX reprocessing the high level waste consists predominantly of fission products and is vitrified at a waste loading of 20–25 wt %. The high level waste produced by more modern and improved Advanced PUREX reprocessing routes, however, contains such high quantities of inert material from the fuel assembly that vitrification at the same waste loading would roughly quadruple the volume of high level waste produced per tonne of fuel reprocessed.

The waste loading is calculated as the mass of waste/total mass of waste immobilising medium or mass of waste/(mass of waste+mass of additives).

It is therefore desirable to be able to accommodate even higher loadings of active waste into the immobilising medium so as to minimise the volume of the final immobilised waste.

It would also be desirable to be able to provide improved operational stability of the waste immobilisation plant in that for a range of fuel assembly compositions the same composition and/or quantity of precursor for forming the immobilising medium may be used.

It is known to use a form of encapsulation utilising a ceramic having a range of crystalline phases wherein the waste ions are dissolved and held in solid solution in the ceramic matrix. An example of this latter form of encapsulation is the material known as "Synroc" (trade name) developed in Australia and comprises a matrix which includes zirconolite ($CaZrTi_2O_7$), perovskite ($CaTiO_3$) and hollandite ($BaAl_2Ti_6O_{16}$) as disclosed in European Patent Application No. 0007236.

However, it is considered that the conventional "Synroc" formulation may have disadvantages for encapsulating the waste envisaged from reprocessed fuel shortly to occur. In particular, because "Synroc" typically comprises a waste loading of only about 20 weight % and generally less than 30 weight %, the large amount of inert material produced with the new reprocessing methods will result in a large increase in the volume of the final immobilised waste.

BRIEF SUMMARY OF THE INVENTION

According to a first aspect of the present invention, there is provided a ceramic waste immobilising medium in which waste from reprocessed nuclear fuel assemblies is contained and in which waste ions from at least fission products in irradiated nuclear fuel may be dissolved in substantially solid solution form, the ceramic waste immobilising medium having a matrix comprising phases of hollandite, perovskite and zirconolite in which matrix said waste ions are dissolved, wherein the waste comprises significant amounts of material from non-fuel components of fuel assemblies.

The immobilising medium preferably comprises a phase of loveringite.

The immobilising medium may comprise an iron rich phase, for example an iron rich spinel type phase. This may be the case where, for example, the waste contains significant amounts of iron from the fuel assembly.

Where the waste does not contain significant amounts of iron, e.g. where the waste arises from the reprocessing of Zircaloy fuel assemblies, the immobilising medium may comprise other phases in preference to e.g. an iron spinel.

The waste immobilising medium utilises the inert material from the fuel assembly in the waste in forming the phases of the matrix.

The waste immobilising medium may comprise metallic phases. The metallic phases may comprise intermetallic alloy phases. The waste immobilising medium may comprise titania-rich buffer phases. The waste immobilising medium may comprise other phases such as davidite and iron in the austenitic phase.

The significant amounts of material from non-fuel components of fuel assemblies in the waste typically comprise iron, chromium, zirconium and nickel.

The zirconium typically assists constitution of the zirconolite phase. The zirconolite phase may have a general formula $CaZrTi_2O_7$ although it may be partly substituted with amounts of other elements. The substitutions may typically comprise rare earth elements. Further other elements may be present in the zirconolite for charge balancing e.g. iron and/or chromium.

Iron and chromium from the waste typically assist constitution of the hollandite phase. The hollandite phase may have a general formula $Ba(Fe,Cr)_2Ti_6O_{16}$. Caesium may be contained in the hollandite phase.

The hollandite phase in the present invention differs from 'natural' hollandite, $Ba(Fe,Mn)_8O_{16}$ which is manganese based. The hollandite phase is titania based similar to the hollandite phase in conventional 'Synroc'. The hollandite phase may, for example, have a formula around $Ba_{1.14}Cr_{2.28}Ti_{5.72}O_{16}$, with some of the Ba replaced by Cs.

Some iron and/or chromium may also be present in the perovskite phase. The perovskite phase may have a general formula $CaTiO_3$, although, as mentioned, it may contain amounts of other elements. Strontium and/or rare earth elements for example may be present in the perovskite.

Iron and/or chromium, eg. residual iron and/or chromium after formation of the aforementioned phases, may assist formation of loveringite. The loveringite may have a general formula $Ca(Fe,Cr,Zr,Ti)_{21}O_{38}$. The loveringite is chemically a flexible phase such that it may accommodate a number of residual elements. A small amount of zirconium and the rare earth elements may partition to this phase.

The waste may comprise fission products from irradiated nuclear fuel. The waste may comprise actinides. The waste may comprise products from the dissolution of the non-fuel components of nuclear fuel assemblies.

The waste element ions occupy lattice sites within the phases of the matrix. A given waste element ion is most likely to occupy that lattice site in which it is most stable, the stability depending upon factors such as the size and charge of the ion. As examples, caesium and rubidium ions may occupy barium ion sites in the hollandite phase; strontium ions may occupy the calcium sites in perovskite; the light rare earth elements and trivalent actinides may also occupy the calcium sites in perovskite; the heavy rare earth elements and tetravalent actinides may occupy sites in the zirconolite phase; iron ions from the waste may occupy sites in an iron spinel phase.

The spinel-type phase also acts as a host for chromium ions. Both iron and chromium ions may also occupy Ti sites.

Some ions may occupy only one type of site, eg $Cs^+$ ions may occupy only $Ba^{2+}$ sites. Furthermore, some ions may occupy only one type of site in only one phase, eg $Sr^{2+}$ ions may occupy the $Ca^{2+}$ sites in $CaTiO_3$ but not in $CaZrTi_2O_7$.

The foregoing description of how the elements/ions may partition themselves in the matrix should not be taken as a definitive explanation of how the invention works but is given merely to illustrate how the invention may work and it should be understood that this does not limit the invention in any way.

The waste comes from a high level radioactive waste stream from so-called Advanced PUREX reprocessing operations which contains large quantities of inert components such as zirconium, iron, chromium and nickel in addition to the fission products and trace actinides.

The waste immobilising medium comprises 30–65 weight % waste. The medium preferably comprises 35–65 weight % waste. More preferably the medium comprises 40–60 weight % waste. The medium may comprise about 50 weight % waste. This is a far higher waste loading than conventional 'Synroc'. Conventional 'Synroc' waste loadings are less than 30 wt % and commonly 5–20 wt %.

The higher waste loading achieved by the present invention means that a substantially smaller volume final waste form is possible compared with the prior art. Reducing the waste loading from, for example, 50% to 33% increases the volume of the final waste form by 50%, i.e. three production lines would be needed instead of two.

The waste immobilising medium of the present invention utilises the waste to assist in the formation of the phases of hollandite, perovskite, zirconolite and possibly other phases, e.g. the iron-rich spinel-type phase. Only titanium oxide ($TiO_2$), calcium oxide (CaO) and barium oxide (BaO) or oxide precursors thereof are needed to be added to the waste to form the required phases. This is in contrast to conventional 'Synroc' which also requires addition of $Al_2O_3$ and $ZrO_2$. The large amounts of zirconium in the waste stream may be utilised by the present invention in forming zirconolite. In addition the Fe and/or Cr facilitate the charge balancing mechanisms necessary for the effective immobilisation of the waste. Surplus iron and/or chromium over that used in charge balancing may form spinel-type phases.

Since a large proportion of the phases are formed from the waste compared to added precursor oxides than in conventional 'Synroc', a much higher loading of waste is achieved.

The preparation of conventional 'Synroc' involves blending the waste at a waste loading of less than 30 wt % with a so-called precursor comprising a mixture of the oxides $TiO_2$, CaO, BaO, $ZrO_2$ and $Al_2O_3$ and optionally other oxides.

In the present invention, the role of the zirconia in a conventional 'Synroc' precursor may be replaced by the zirconia in the waste and the role of the alumina may be replicated by the first row transition metal ions in the waste. Accordingly, the present invention dispenses with the need to include $ZrO_2$ and $Al_2O_3$ in the precursor.

Iron and chromium from the waste may replace the aluminium in convention 'Synroc'.

In addition to the decrease in complexity of the preparation procedure, this importantly enables the waste loading in the final waste immobilising medium to be increased as the place of precursor components in conventional 'Synroc' is taken up by waste.

According to a second aspect of the present invention there is provided a method of immobilising waste from reprocessed nuclear fuel assemblies, the waste comprising significant amounts of material from non-fuel components of fuel assemblies, the method comprising the steps of mixing a liquor containing said waste with a precursor material comprising oxides or oxide precursors of at least titanium, calcium and barium to form a slurry; drying said slurry; and calcining said dried slurry under a reducing atmosphere to form a powder.

The powder comprises 30–65 wt % waste. The powder preferably comprises 35–65 wt % waste. More preferably the powder comprises 40–60 wt % waste.

The powder may be subsequently compacted and sintered to form a ceramic waste immobilising medium which is suitable for long term storage.

The present invention utilises the waste to replicate the function of some of the precursor oxides in conventional 'Synroc', in particular the function of the $ZrO_2$ and $Al_2O_3$.

Zirconia and alumina are not essential to the precursor material used in the present invention. The present precursor material requires only titania ($TiO_2$), calcium oxide (CaO) and barium oxide (BaO) or oxide precursors of Ti, Ca and/or Ba. The advantage in being able to dispense with the alumina and zirconia is that this allows a higher loading of waste to be encapsulated than is possible with conventional 'Synroc'. A 40–60 weight % loading of waste is most preferably encapsulated using the present invention.

In addition to $TiO_2$, CaO and BaO, or the oxide precursors thereof, one or more other oxides or oxide precursors, e.g. $Al_2O_3$ or $ZrO_2$, may be optionally included in the precursor for fine adjustment of the matrix constituent proportions.

The waste liquor may contain a plurality of fission product elements selected from the following: Se, Rb, Sr, Y, Zr, Mo, Tc, Ru, Rh, Pd, Ag, Cd, In, Sn, Sb, Te, Cs, Ba, La, Ce, Pr, Nd, Pm, Sm, Eu, Gd. In addition the waste liquor may contain a plurality of the following elements which may arise from the fuel assembly, Fe, Zr, Ni, Cr, Mn, Mo. Gadolinium may also be present in the waste liquor from its use as a neutron poison. There may be traces of actinides present. A typical composition of a waste stream arising from Advanced PUREX reprocessing is shown in Table 1. The composition is based on the reprocessing of fuel in a ratio of 3 tonnes high burn-up uranium oxide and one tonne MOX, i.e. 3 $UO_2$ fuel assemblies reprocessed for every MOX fuel assembly. The amounts shown are amounts of the corresponding oxides. The species in the third column are the species which were used as analogues for the oxides in the first column in the Example described below.

TABLE 1

COMPOSITION OF SIMULATED HIGHLY ACTIVE WASTE STREAM

| Oxide | Grams per tonne fuel reprocessed assuming 3:1 blend of $UO_2$:MOX | Analogue used in simulated waste form |
|---|---|---|
| FISSION PRODUCTS | | |
| $SeO_2$ | 105.3 | as $TeO_2$ |
| $Rb_2O$ | 542.6 | as $Cs_2O$ |
| SrO | 1371.0 | |
| $Y_2O_3$ | 810.1 | |
| $ZrO_2$ | 7364.3 | |
| MoO3 | 8087.3 | |
| $TcO_2$ | 1813.5 | behaves as $TiO_2$ |
| $RuO_2$ | 5121.3 | |
| $Rh_2O_3$ | 823.8 | as $Ag_2O$ |
| PdO | 3398.8 | as $Ag_2O$ |
| $Ag_2O$ | 134.9 | |
| CdO | 295.8 | as $Ag_2O$ |
| $In_2O_3$ | 2.1 | not in analogue |
| $SnO_2$ | 161.9 | |
| $Sb_2O_3$ | 26.2 | not in analogue |
| $TeO_2$ | 1009.5 | |
| $Cs_2O$ | 4451.3 | |
| BaO | 3165.8 | |
| $La_2O_3$ | 2406.8 | as $Nd_2O_3$ |
| $Ce_2O_3$ | 4490.8 | |
| $Pr_2O_3$ | 2168.5 | as $Nd_2O_3$ |
| $Nd_2O_3$ | 7610.5 | |
| $Pm_2O_3$ | 54.1 | as $Nd_2O_3$ |
| $Sm_2O_3$ | 1498.8 | as $Nd_2O_3$ |
| $Eu_2O_3$ | 336.5 | as $Nd_2O_3$ |
| $Gd_2O_3$ | 324.4 | |
| FROM THE FUEL ASSEMBLY | | |
| $Fe_2O_3$ | 63770 | |
| $ZrO_2$ | 49910 | |
| NiO | 19470 | |
| $Cr_2O_3$ | 21050 | |
| MnO | 1550 | |
| $MoO_3$ | 750 | |
| $SnO_2$ | 760 | |
| NEUTRON POISON | | |
| $Gd_2O_3$ | 9100 | |

In the waste liquor many of the waste elements may be present in the form of nitrates because of the use of nitric acid in the reprocessing operations.

Preferably, the waste liquor is denitrated before mixing with the precursor. This makes further processing of the waste liquor easier. If the liquor is not denitrated, an undesirable sludge or paste may be formed upon mixing with the precursor which may be difficult to dry effectively.

The denitration may be performed in one of many ways. A preferred method of denitration comprises reacting the liquor with formaldehyde.

After denitration, the liquor remains in the liquid phase although some components, for example the iron, may precipitate out of solution, for example in the form of iron hydroxide.

The denitrated liquor is then mixed with the precursor material to form a homogenous mixture. Typically the mixture is a slurry. The two may be mixed with stirring to ensure homogeneity in the slurry. Other methods of homogeneously mixing may be used.

Rather than comprising the oxides $TiO_2$, CaO and BaO themselves, the precursor may, at least initially, instead comprise oxide precursors, i.e. compounds which can generate $TiO_2$, CaO and BaO. The precursor may, for example, comprise metal alkoxides or metal hydroxides. References herein to the precursor containing the oxides $TiO_2$, CaO and BaO thus includes reference to the precursor containing the corresponding metal alkoxides or hydroxides.

In the precursor, the titanium may initially be present in the form of a titanium alkoxide such as titanium isopropoxide. The titanium alkoxide may be hydrolysed to $TiO_2$ by the addition of water which may contain the calcium and barium oxides or compounds which may generate the calcium and barium oxides such as calcium and barium hydroxide. The solution containing the calcium and barium may be hot.

The organic alkoxide component is preferably driven off from the hydrolysed precursor solution before mixing with the waste liquor.

The precursor is preferably provided as a liquid suspension to assist the homogeneous mixing with the waste liquor.

The waste and additives may be mixed in the proportions 35–65 wt % Advanced PUREX waste, 30–60 wt % $TiO_2$, 1–10 wt % BaO and 1–10 wt % CaO. Preferably the proportions are 40–60 wt % Advanced PUREX waste, 30–50 wt % $TiO_2$, 2–10 wt % BaO and 4–10 wt % CaO. One example used by the applicant was 50 wt % waste, 40.4 wt % TiO2, 6.0 wt % CaO and 3.6 wt % BaO.

Optionally, other oxides, e.g. $Al_2O_3$, $ZrO_2$ and/or niobium oxide, may be included with corresponding adjustments to the amounts of the other components whilst keeping the waste in the range 40–60 wt %.

The precursor may contain no alumina or zirconia, in contrast to conventional 'Synroc'.

After the waste liquor and precursor have been mixed to form the slurry, the slurry is dried. The drying may be carried out by one of many methods known to the skilled man.

After the slurry has been dried, it is calcined to form a powder. The calcination is preferably carried out in a reducing atmosphere. The reducing atmosphere may comprise an $Ar/H_2$ mixture or a $N_2/H_2$ mixture. The hydrogen is typically diluted to 10% or less in the inert gas. For example, a 5% mixture of $H_2$ in $N_2$ may be used. The greater the concentration of hydrogen which is used, the less time will be needed to carry out the calcination. However, safety considerations may impose upper limits on the amount of hydrogen which can be used.

The calcination may be carried out between 650–800° C. Typically, about 750° C. may be used.

The reducing atmosphere desirably reduces the noble metal oxides to the metal and the trivalent iron to the divalent and metallic states.

In particular, it is desirable to reduce the valency of Ru, Mo, Pd and Rh. Preferably, there should be as little hexavalent $Mo^{6+}$ as possible after reduction to avoid volatilisation. Otherwise, $Mo^{6+}$ may combine with caesium to form the soluble caesium molybdate which is undesirable. Reduction to Mo metal, for example, overcomes this problem. The Ni from the waste may be reduced to Ni metal and technetium may be reduced to $Tc^{4+}$ or Tc metal. Intermetallic compounds or alloys of the reduced metal elements may be formed. Also, metallic solid solutions based on Fe and Ni may be formed.

Finally, the calcined powder may be compacted and sintered to produce the final form for long term storage.

Prior to compaction and sintering, the calcined powder may be blended with a small quantity, eg 2 wt %, of an oxygen getter. The oxygen getter may be titanium or iron.

The compaction and sintering may be carried out according to known methods such as Hot Uniaxial Pressing or Hot Isostatic Pressing (HIP). HIP is preferred. Preferably the temperature for HIP is 1000–1400° C. More preferably the temperature for HIP is 1100–1300° C. The HIP, may, for example, be carried out at about 1300° C. and about 200 Mpa for about two hours. The pressure may be lower or higher than 200 Mpa.

The final pressed and sintered waste form is highly leach resistant. Leach rates are similar to conventional 'Synroc'. The leach rates of 'Synroc' materials are typically two orders of magnitude lower than for borosilicate glass. A sample of normalised leach rates for the present invention for the first day of leaching for 'important' elements in grams per sq meter per day are: 0.3 for Cs; 0.15 for Ba; 0.15 for Sr; 0.8 for Mo.

Fuel assembly designs vary from reactor to reactor and consequently so will the composition of the waste stream. One option is to have a dedicated precursor formulation and waste loading for each fuel assembly type. That approach should enable minimisation of total waste volumes. However, improved plant flexibility can be achieved if a single precursor formulation and constant precursor feed rate is possible. Advantageously, it has been found that the same precursor formulation can be used at a fixed quantity per tonne of fuel reprocessed for a range of fuel assembly designs. That is, it has been found that a range of waste stream compositions, arising from a selection of fuel assemblies processed by an electrochemical dissolution route, can be immobilised. The phase assemblage contains zirconolite, hollandite, perovskite and, commonly, loveringite. Commonly, metallic phases are also formed. The flexibility is facilitated by variations in the relative amounts of the phases. In the case of a fuel assembly having higher levels of iron and chromium there is also the formation of a spinel phase. Thus for the range of fuel assemblies the precursor composition can be the same and the quantity of precursor per tonne of fuel reprocessed can be constant allowing improved operational stability of the waste immobilisation plant.

BRIEF DESCRIPTION OF THE DRAWING

Specific embodiments of the present invention will now be described by way of the following Examples and with reference to FIG. 1 which shows an X-Ray Diffraction (XRD) pattern of a sample of a waste immobilising medium according to the present invention. The embodiments are illustrative only and do not limit the invention in any way.

DETAILED DESCRIPTION OF THE INVENTION

EXAMPLE 1

Figure 1:
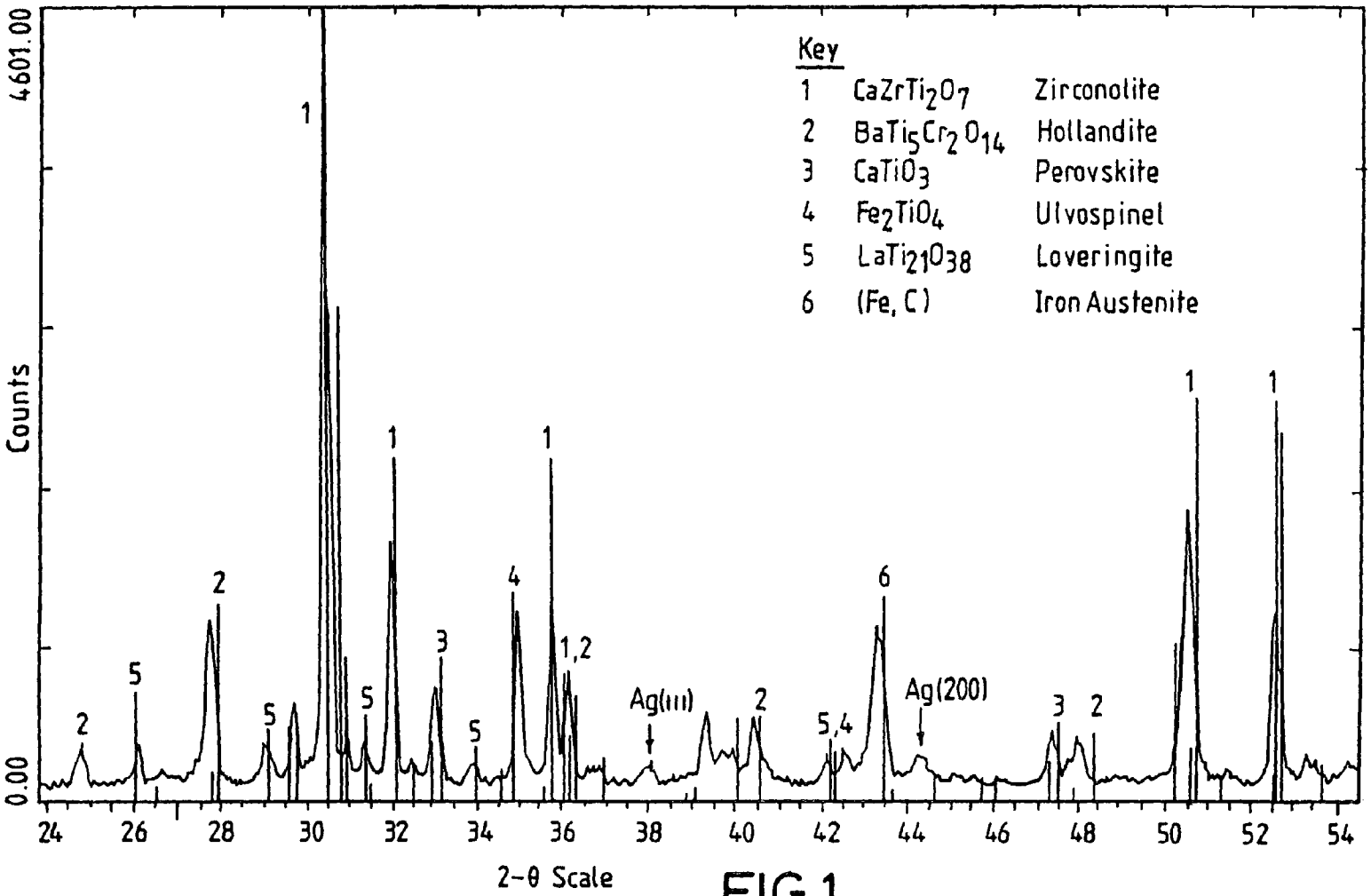

In the encapsulation of a real waste from Advanced PUREX reprocessing, the denitrated waste liquor containing the waste ions to be encapsulated will be blended with the precursor containing the $TiO_2$, CaO and BaO to form the slurry mixture. The slurry will then be dried and calcined as described above.

For experimental convenience, however, the mixture of waste ions and $TiO_2$, CaO and BaO in this example was prepared by a slightly different route. Provided there has been homogenous mixing, the manner of forming the slurried mixture of waste, $TiO_2$, CaO and BaO is not important, as the calcining step renders the history of the slurry irrelevant.

The composition of the simulated waste used in the experiment is given in Table 2. The relative amounts of the components in weight % are based on the oxides. The list of components in Table 2 does not include all of the components listed in Table 1 because many of the components were replicated by a simulant. Neodymium was used as a simulant for all of rare earth elements except gadolinium and cerium; silver as a replacement for rhodium, palladium and cadmium; and tellurium as a substitute for selenium. Technetium was omitted, but in its tetravalent state which will exist under the reducing conditions during fabrication, it is expected to occupy octahedral Ti sites within the assemblage or exist as Tc metal.

TABLE 2

| BULK COMPOSITION OF SIMULATED WASTE IN WT % | |
|---|---|
| SrO | 0.62 |
| $Y_2O_3$ | 0.36 |
| $MoO_3$ | 3.97 |
| $RuO_2$ | 2.30 |
| $Ag_2O$ | 2.09 |
| $SnO_2$ | 0.41 |
| $TeO_2$ | 0.52 |
| $Cs_2O$ | 2.37 |
| BaO | 1.42 |
| $Ce_2O_3$ | 2.02 |
| $Nd_2O_3$ | 6.35 |
| $Gd_2O_3$ | 4.24 |
| $Fe_2O_3$ | 28.66 |
| $ZrO_2$ | 25.74 |
| NiO | 8.75 |
| $Cr_2O_3$ | 9.46 |
| MnO | 0.70 |
| | 100.00 |

A waste immobilising medium was prepared having the composition: 50 wt % waste, 40.4% $TiO_2$, 3.6 wt % BaO and 6.0 wt % CaO.

The waste immobilising medium was prepared as follows. A concentrated solution of the highly soluble nitrates of iron, chromium, nickel, calcium, manganese, yttrium, silver, tin, cerium, neodymium, and gadolinium was prepared first. Included in the solution was ruthenium as ruthenium nitrosyl nitrate, molybdenum as ammonium molybdate. Tellurium as telluric acid was added later. This solution was then denitrated by reacting with formaldehyde. Separately from the denitrated solution, appropriate amounts of titanium and zirconium isopropoxide were mixed with an equal volume of ethanol and hydrolysed by rapid addition of a hot solution of the nitrates of barium, caesium and strontium. The first denitrated solution was then added to this and the whole mixture was homogenised using a shear dispersing tool prior to stir drying on a hot plate.

Calcination was then carried out at 750° C. in a rotary calciner with a flowing 5% $H_2$ in $N_2$ atmosphere. The quantity of hydrogen required to reduce all of the noble metal oxides to the metal and the trivalent iron to the divalent state was calculated and, accordingly, a gas flow rate of 1 liter per minute was used for a calcining time of 1000 minutes. This ensured complete reduction.

After calcining, the powders were ground in a pestle and mortar and portions were blended with 2 wt % of either titanium or iron to act as an oxygen getter during HIP. Two portions were thus produced and designated respectively as RPS20-T (for the titanium gettered sample) and RPS20-F (for the iron gettered sample). The portions were then packed into 12% Cr stainless steel cans which were evacuated and sealed prior to hot isostatic pressing at 1300° C. and 200 MPa for two hours. The waste form was retrieved by core drilling.

Static leach tests were carried out using standard techniques. Normalised leach rates for the first day of leaching for 'important' elements in grams per sq meter per day were: a maximum of 0.3 for Cs; 0.04 for Ba; a maximum of 0.2 for Sr; 0.8 for Mo. These values decreased with time.

Samples were subjected to X-ray diffraction (XRD) analysis. An XRD pattern is shown in FIG. 1. FIG. 1 also shows the theoretical peak positions calculated for numerous phases as indicated by reference numerals 1 to 6. The theoretical peaks fit well with the experimental data. The data shows the presence of numerous phases including zirconolite, perovskite, barium chromium titanium oxide (the hollandite-type phase), ulvospinel, loveringite, iron austenite and silver-rich phase.

SEM photographs were also taken of a sample of the waste immobilising medium. The typical grain size was around 1–2 microns. The grains were also all about the same size. This grain size is coarser than would be aimed for in practice because that makes the characterisation of the waste form easier (the samples here were hot isostatically pressed at 1300° C. but 1200° C. would produce a finer grain size and better properties such as resistance to radiation damage). Using 'backscatter' contrast, so that the phases with higher average atomic number appear brighter, the SEM showed phases of metal, generally either a nickel/iron/ruthenium solid solution or silver. Also observed were areas corresponding to zirconolite and hollandite respectively. Areas corresponding to the other three ceramic phases (perovskite, spinel and loveringite) were seen but were not easily distinguished from each other by sight.

EXAMPLE 2

The ability to immobilise different waste stream compositions due to different reactor fuel assembly designs was investigated. The fuel assembly compositions and waste stream compositions for various fuel assembly types denoted A–H for both PWR and BWR plants are given in Tables 3 and 4. Table 3 contains the raw data for each fuel assembly type whilst in Table 4 these figures have been converted to the waste oxides in the raffinate per tonne of fuel reprocessed—this conversion has been carried out because the chemical separation stage in a reprocessing plant operates on a throughput based on tonnes of fuel per day. It was investigated whether improved plant flexibility could be achieved by using a single precursor formulation and constant precursor feed rate for all assembly types. Consequently, in this example it was tested whether the same precursor could be used at a fixed quantity per tonne of fuel reprocessed for the range of different fuel assembly and waste compositions.

The fuel assembly type C was used as a starting point with a 50% waste loading. Then the same quantity and composition of precursor was used for the remaining seven fuel assembly types. Because the type C fuel assembly had the greatest mass of waste oxides, the waste loadings for the other fuel assemblies were less than 50%. The mass and volume of waste form produced, and the waste loadings are also recorded in Table 4.

Waste forms were prepared by the same basic procedure as in Example 1. After drying on a hot plate, each waste form batch was calcined for 600 minutes at 750° C. in a stream of $N_2$-5% $H_2$ flowing at 1 liter per minute. Following calcination the batches were balled milled and portions were blended with 2 wt % metallic titanium prior to hot isostatic pressing for 2 hours at 1300° C. and 200 MPa.

After fabrication, the waste forms were leach tested and characterised by X-ray diffraction and scanning electron microscopy. Leach tests were carried out in triplicate for 24 hours at 100° C.

TABLE 3

RAW DATA ON COMPONENTS OF FUEL ASSEMBLIES

| Fuel Assembly | $UO_2$ | 304SS | Inconel 718 | Zircaloy 4 |
|---|---|---|---|---|
| | PWR assemblies types | | | |
| A | 533.0 | 23.0 | 0.0 | 199.4 |
| B | 458.4 | 12.7 | 8.0 | 122.3 |
| C | 350.0 | 23.0 | 7.1 | 103.5 |
| D | 447.4 | 11.6 | 7.7 | 122.0 |
| E | 422.2 | 12.7 | 10.2 | 131.9 |
| | BWR assemblies types | | | |
| F | 172.1 | 7.2 | 0.0 | 56.9 |
| G | 171.4 | 6.5 | 0.0 | 56.2 |
| H | 166.2 | 6.9 | 0.6 | 56.4 |

TABLE 4

FUEL ASSEMBLY DATA NORMALISED TO ONE TONNE OF FUEL (HM) PRE-IRRADIATION ALL VALUES IN KILOGRAMS

| | A | B | C | D | E | F | G | H |
|---|---|---|---|---|---|---|---|---|
| $Fe_2O_3$ | 43.64 | 33.32 | 71.71 | 31.51 | 37.80 | 42.22 | 38.35 | 42.99 |
| $Cr_2O_3$ | 12.53 | 12.93 | 24.31 | 12.38 | 15.52 | 12.10 | 11.01 | 13.02 |
| NiO | 4.98 | 14.75 | 20.98 | 14.38 | 19.46 | 4.82 | 4.37 | 7.17 |
| $SiO_2$ | 0.92 | 0.60 | 1.41 | 0.56 | 0.64 | 0.90 | 0.81 | 0.90 |
| MnO | 1.11 | 0.72 | 1.70 | 0.67 | 0.78 | 1.08 | 0.98 | 1.07 |
| $MoO_3$ | 0.00 | 0.79 | 0.91 | 0.77 | 1.09 | 0.00 | 0.00 | 0.16 |

TABLE 4-continued

| FUEL ASSEMBLY DATA NORMALISED TO ONE TONNE OF FUEL (HM) PRE-IRRADIATION ALL VALUES IN KILOGRAMS | | | | | | | | |
|---|---|---|---|---|---|---|---|---|
| | A | B | C | D | E | F | G | H |
| $Nb/Ta_2O_5$ | 0.00 | 1.25 | 1.45 | 1.23 | 1.73 | 0.00 | 0.00 | 0.26 |
| $ZrO_2$ | 74.34 | 53.02 | 58.76 | 54.19 | 62.08 | 65.74 | 65.14 | 67.41 |
| $SnO_2$ | 1.07 | 0.76 | 0.84 | 0.78 | 0.89 | 0.95 | 0.94 | 0.97 |
| Fission Products | 57.90 | 57.90 | 57.90 | 57.90 | 57.90 | 57.90 | 57.90 | 57.90 |
| $Gd_2O_3$ | 9.10 | 9.10 | 9.10 | 9.10 | 9.10 | 9.10 | 9.10 | 9.10 |
| Actinides | 3.30 | 3.30 | 3.30 | 3.30 | 3.30 | 3.30 | 3.30 | 3.30 |
| Total | 207.97 | 187.82 | 250.97 | 186.22 | 209.65 | 197.21 | 191.09 | 203.36 |
| Mass precursor (kg) | 250.97 | 250.97 | 250.97 | 250.97 | 250.97 | 250.97 | 250.97 | 250.97 |
| Waste form mass (kg) | 458.94 | 438.79 | 501.93 | 437.18 | 460.61 | 448.18 | 442.06 | 454.33 |
| Waste volume ($m^3$) | 0.102 | 0.098 | 0.112 | 0.097 | 0.102 | 0.100 | 0.098 | 0.101 |
| Waste loading | 0.453 | 0.428 | 0.500 | 0.426 | 0.455 | 0.440 | 0.432 | 0.448 |

After HIP, XRD traces showed that all of the waste forms contain zirconolite, [$CaZrTi_2O_7$] hollandite, [$Ba(Cr,Fe)_2Ti_6O_{16}$], perovskite [$CaTiO_3$] and loveringite [$Ca(Ti,Fe,Cr,Zr)_{21}O_{38}$] together with various metal phases but there were variations in the levels of certain phases. Only Type C showed spinel formation due to the high levels of iron and chromium. The quantity of perovskite decreased with increasing levels of zirconia in the waste stream as higher zirconia levels promote zirconolite formation and hence less calcium is available to form perovskite.

The microstructures of the waste forms were similar.

Leach data for caesium, barium and molybdenum are recorded in Table 5. This table contains the mean values from each of three tests. For all formulations, the leach rates are comparable with reference grade Synroc C, confirming effectively complete immobilisation of the waste species.

Despite the differences in waste stream compositions, the given phase assemblage clearly has ample flexibility to produce a durable waste form by using a constant precursor formulation. This is achieved by varying both the proportions of the phases present and to a lesser degree the composition of those phases. The loveringite type phase assists phase stability. It acts as a buffer in a similar manner to Magneli phases in Synroc C.

TABLE 5

| NORMALISED CAESIUM, MOLYBDENUM AND BARIUM LEACH RATES FOR WASTE FORMS ($g\ m^{-2}\ d^{-1}$) | | | |
|---|---|---|---|
| | Caesium | Molybdenum | Barium |
| E | 0.20 | 0.31 | 0.13 |
| D | 0.23 | 0.50 | 0.15 |
| B | 0.29 | 0.74 | 0.15 |
| A | 0.18 | 0.49 | 0.09 |
| C | 0.21 | 0.75 | 0.04 |
| H | 0.19 | 0.34 | 0.11 |
| G | 0.17 | 0.34 | 0.12 |
| F | 0.21 | 0.76 | 0.08 |
| MIXED | 0.17 | 0.48 | 0.09 |

The invention claimed is:

1. A ceramic waste immobilising medium in which waste from reprocessed nuclear fuel assemblies is contained and in which waste ions from at least fission products in irradiated nuclear fuel may be dissolved in substantially solid solution form, the ceramic waste immobilising medium having a matrix comprising phases of hollandite, perovskite and zirconolite, in which matrix said waste ions are dissolved, wherein the waste comprises material from non-fuel components of fuel assemblies, iron and zirconium from non-fuel components being the most abundant elements in the waste, wherein said non-fuel components are utilized in the formation of the matrix of the ceramic waste immobilising medium which consists essentially of $TiO_2$, CaO and BaO and wherein the resulting ceramic waste immobilizing medium comprises 30–65 weight % waste.

2. A ceramic waste immobilising medium as in claim 1 which comprises 35–65 weight % waste.

3. A ceramic waste immobilising medium as in claim 1 which comprises 40–60 weight % waste.

4. A ceramic waste immobilising medium as in claim 1 wherein the matrix includes a loveringite phase.

5. A ceramic waste immobilising medium as in claim 1 wherein the matrix includes an iron-rich phase.

6. A ceramic waste immobilizing medium as in claim 5 wherein the iron-rich phase includes an iron-rich spinel type phase.

7. A ceramic waste immobilising medium as in claim 1 wherein the matrix comprises one or more phases selected from the group consisting of metallic phases, intermetallic alloy phases, titania-rich buffer phases, davidite and iron austenite.

8. A ceramic waste immobilising medium as in claim 1 wherein the waste is from a high level radioactive waste stream from advanced PUREX reprocessing operations which contains substantial quantities of zirconium, iron, chromium and nickel.

9. A ceramic waste immobilising medium as in claim 5 wherein the iron-rich phase is formed substantially from iron present in the waste.

* * * * *